US007160628B2

(12) United States Patent
Bellman et al.

(10) Patent No.: US 7,160,628 B2
(45) **Date of Patent: *Jan. 9, 2007**

(54) OPAQUE CHROME COATING HAVING INCREASED RESISTANCE TO PINHOLE FORMATION

(75) Inventors: Robert Bellman, Painted Post, NY (US); Ljerka Ukrainczyk, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/971,618

(22) Filed: Oct. 21, 2004

(65) Prior Publication Data

US 2006/0088704 A1 Apr. 27, 2006

(51) Int. Cl.
*C03C 27/02* (2006.01)
*G03C 5/00* (2006.01)

(52) U.S. Cl. ..... 428/632; 428/635; 430/2; 430/313; 430/316; 430/317; 430/318; 430/322

(58) Field of Classification Search ..... 428/209, 428/615, 620, 195, 632, 635; 430/5, 313, 430/316–318, 322
See application file for complete search history.

(56) References Cited

U.S. PATENT DOCUMENTS 5,230,971 A 7/1993 Aplay
5,292,623 A * 3/1994 Kemp et al. ..... 430/313
5,780,187 A * 7/1998 Pierrat ..... 430/5
5,976,639 A 11/1999 Iwata
6,472,107 B1 * 10/2002 Chan ..... 430/5
6,887,627 B1 * 5/2005 Chung et al. ..... 430/5
6,908,716 B1 * 6/2005 Chan ..... 430/5

OTHER PUBLICATIONS

J. D. Rancort, "Optical Thin Films User Handbook", SPIE Opt. Eng. Press, Bellingham, WA (1996) pp. 126-129.
P. Baumeister, "Starting designs for the computer optimization of optical coatings", Appl. Opt. 34(22) 4835 (1995).
Nakajima, K.; Onisawa, K.-I.; Chahara, K.-I.; Minemura, T.; Kamei, M.; Setoyama, E, "Stress reduction of chromium thin films deposited by cluster-type sputtering systems for ultra-large-size (550x650mm) substrates," Vacuum, 51(4) 761 (1998).
Zhao, Z.B.; Yalisove, S.M.; Rek, Z.U.; Bilello, J.C., "Evolution of anistrpic microstructure and residual stress in sputtered Cr films," Journal of Applied Physics, 92 (12) 7183 (2002).
Hoffman, D.W., "Internal stresses in Cr, Mo, Ta and Pt films deposited by sputtering from a planar magnetron source," J. Vac. Sci. Techn. 20(3) 355 (1982).
H. Chen, T. Wang, F. Ko, and C. Hsieh, "Multilayer Bottom Antireflective Coatings for High Numerical Aperture and Modified Illumination Exposure Systems", Jap. J. App. Phys. 1 42(6B) 3737 (2003).

* cited by examiner

*Primary Examiner*—Cathy F. Lam
(74) *Attorney, Agent, or Firm*—Walter M. Douglas; Timothy M. Schaeberle

(57) ABSTRACT

A substrate with a patterned opaque coating formable into an opaque aperture in one process is provided. The opaque coating includes at least a bottom layer and a top layer. The bottom and top layers each include a material selected from the group consisting of chrome and chrome oxide. The top layer has a compressive stress, which makes the opaque coating more resistant to pinhole formation during downstream processing.

26 Claims, 2 Drawing Sheets

OPAQUE CHROME COATING HAVING INCREASED RESISTANCE TO PINHOLE FORMATION

BACKGROUND OF INVENTION

Opaque chrome coating has been used for many years as a low-reflectance, opaque aperture coating for optical elements, photomasks, and black matrix for LCD displays. Opaque chrome coating typically has three layers: a very thin chrome (Cr) flash for adhesion to a substrate, followed by a chrome oxide ($CrO_x$) layer for low reflection, followed by a thicker chrome (Cr) layer for opacity. The thickness and composition of the opaque ($Cr/CrO_x/Cr$) coating layers are chosen to achieve a desired opacity and low reflectance. Optimal layer composition and thickness may be experimentally determined or derived (P. Baumeister, "Starting designs for the computer optimization of optical coatings," Appl. Opt. 34(22) 4835 (1995)). Carbon and nitrogen are often added to improve the reflectance and etch resistance of some of the layers (e.g., U.S. Pat. No. 5,230,971 issued to Alpay). More complex opaque chrome coating structures are known (e.g., U.S. Pat. No. 5,976,639 issued to Iwata).

Opaque $Cr/CrO_x/Cr$ coating layers are usually deposited on a substrate by a physical vapor deposition technique, typically thermal evaporation, e.g., electron beam evaporation or resistance evaporation, or sputtering. One of the most economical methods for depositing opaque $Cr/CrO_x/Cr$ coating layers on a substrate is ion-assisted electron beam evaporation. In general, the method involves sequentially generating vapors of chrome and chrome oxide using an electron beam evaporator and depositing the vapors on a substrate while bombarding the film growing on the substrate with a low energy ion beam. The ion bombardment allows for denser and more uniform films than without ion assist. The more uniform the films, the more consistent the optical properties of the opaque $Cr/CrO_x/Cr$ coating. The denser the films, the more resistant the opaque $Cr/CrO_x/Cr$ coating is to cracking and pinhole formation. An aperture can be patterned in the opaque $Cr/CrO_x/Cr$ coating layers with standard photolithography.

Opaque $Cr/CrO_x/Cr$ coating layers deposited with ion-assisted beam evaporation are generally not robust during downstream processing. A simple ultrasonic cleaning of the opaque $Cr/CrO_x/Cr$ coating can produce many pinholes in the coating. Patterning of the opaque $Cr/CrO_x/Cr$ coating increases the pinhole density in the coating. It is known that chrome typically grows with a columnar structure, which causes tensile stress, (Nakajima, K. et al., Vacuum, 51(4) 761 (1998) and Zhao, Z. B. et al., Journal of Applied Physics, 92(12) 7183(2002)), and that the stress of Cr layers deposited by ion-assisted electron beam evaporation is typically high and tensile. The tensile stress and columnar microstructure are believed to be responsible for the increased pinhole density during patterning. A crack or defect in a film in tensile stress tends to pull apart to release the stress. Water from the aqueous processing steps of the photolithography can enter the cracks and voids between the columnar grains. The shear stress applied to the film during lamination can open up cracks and pinholes.

The robustness of opaque $Cr/CrO_x/Cr$ coating downstream processing can be improved by reducing or eliminating the tensile stress in the opaque $Cr/CrO_x/Cr$ coating layers. The tensile stress in the opaque $Cr/CrO_x/Cr$ coating may be reduced by depositing the opaque $Cr/CrO_x/Cr$ coating layers by sputtering or ion-assisted deposition with high DC bias (Nakajima, K. et al., Vacuum, 51(4) 761 (1998) and Zhao, Z. B. et al., Journal of Applied Physics, 92(12) 7183 (2002)). However, experiments show that ion-assisted electron beam deposition with high DC bias cannot fully eliminate the tensile stress in the thicker, top chrome (Cr) layer. The sputtering methods for depositing opaque $Cr/CrO_x/Cr$ coating layers are not economical because of the high capital cost of the sputtering equipment—inline or load-locked planar magnetron systems are needed to achieve both high throughput and compressively-stressed opaque $Cr/CrO_x/Cr$ coating (Hoffmnan, D. W., Journal of Vacuum Science Technology, 20(3) 355 (1982)).

SUMMARY OF INVENTION

In one aspect, the invention relates to a substrate with a patterned opaque coating formable into an opaque aperture in one process. The opaque coating comprises at least a bottom layer and a top layer. The bottom and top layers each comprise a material selected from the group consisting of chrome and chrome oxide. The top layer has a compressive stress.

In another aspect, the invention relates to a substrate with a patterned opaque coating formable into an opaque aperture in one process. The opaque coating comprises a first layer containing chrome, followed by a second layer containing chrome oxide, followed by a third layer containing chrome, followed by a fourth layer containing chrome oxide, wherein the fourth layer has a compressive stress.

In yet another aspect, the invention relates to a method of making a substrate with a patterned opaque coating formable into an aperture in one process. The method comprises depositing a bottom layer on a surface of the substrate and depositing a top layer on the bottom layer such that the top layer has a compressive stress. The bottom and top layers each comprise a material selected from the group consisting of chrome and chrome oxide.

Other features and advantages of the invention will be apparent from the following description and the appended claims.

DETAILED DESCRIPTION OF PREFERRED EMBODIMENTS

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

Embodiments of the invention provide an opaque chrome coating having increased resistance to pinhole formation during downstream processing, such as cleaning and photolithography. The opaque chrome coating can be used as a low reflectance, opaque aperture coating for optical elements, photomasks, and black matrix for LCD displays. Generally speaking, the opaque chrome coating is useful in optical applications requiring light to be constrained to an active area of an optical device, such as an array device. The opaque chrome coating is formable into an opaque aperture in one process. The process could be photolithography etch-back or lift-off. The invention is based in part on the discovery that topping an opaque $Cr/CrO_x/Cr$ coating with a compressively-stressed chrome oxide ($CrO_x$) layer entirely or substantially eliminates pinhole formation during patterning of the coating. The invention is also based in part on the discovery that chrome oxide ($CrO_x$) deposited with ion-assisted electron beam evaporation has a compressive stress.

Figure 1A:
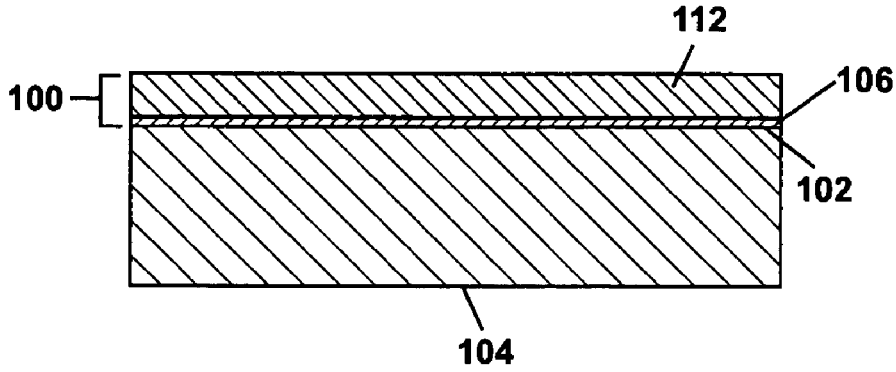
FIG. 1A is a vertical cross-section of an opaque chrome coating on a substrate according to an embodiment of the invention.
Figure 1B:
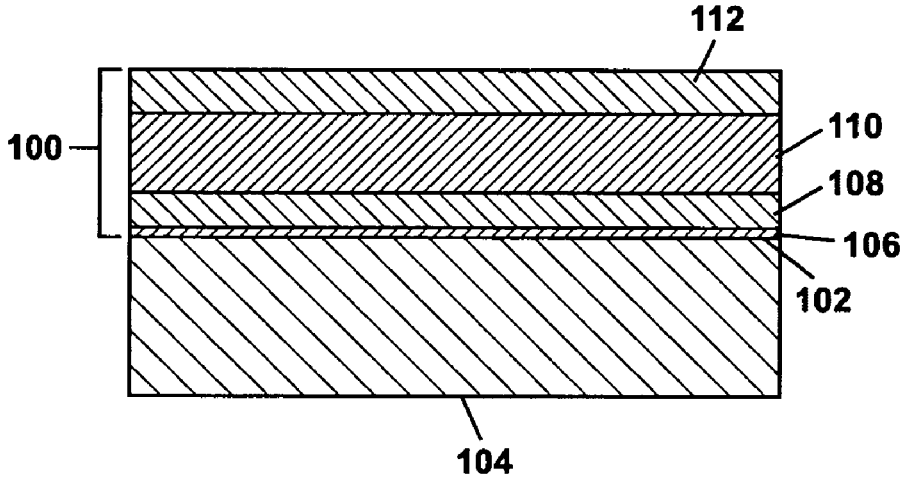
FIG. 1B is a vertical cross-section of an opaque chrome coating on a substrate according to another embodiment of the invention.

FIG. 1A shows a cross-section of an opaque chrome coating 100 according to an embodiment of the invention. The opaque chrome coating 100 is deposited on the surface 102 of a substrate 104. Prior to depositing the opaque chrome coating 100 on the surface 102, the surface 102 may be coated with an antireflection material and/or a patterned photoresist or other desired material. The substrate 104 may be made of a material that is transparent to light at the wavelengths of interest. Examples of materials for visible light applications are glass and polymer, but the invention is not limited to visible light applications. The opaque chrome coating 100 includes at least two layers, a bottom layer 106 and a top layer 112. Each opaque chrome coating 100 layer includes chrome or chrome oxide ($CrO_x$), or more generally chrome and oxygen. Additional elements, such as carbon and nitrogen, may be included in one or more of the opaque chrome coating 100 layers. The top layer 112 has a compressive stress, which increases the resistance of the opaque chrome coating 100 to pinhole formation, which makes the opaque chrome coating 110 more robust during downstream processing. The compressive stress in the top layer 112 is at least −20 MPa, preferably less than −100 MPa, more preferably less than −170 MPa The thickness and composition of the opaque chrome coating 100 layers are selected such that the opaque chrome coating 100 has a desired opacity, low reflectance, pinhole formation resistance, and adhesion strength. The optimal thickness and composition of the opaque chrome coating 100 layers may be experimentally determined or derived. To allow more flexibility in achieving the desired properties of the opaque chrome coating 100 layers, it is preferable to dispose additional layers between the bottom and top layers 106, 112 illustrated in FIG. 1A. That is, at least one additional layer between the top and bottom layers. FIG. 1B shows two additional layers 108, 110 (a first middle layer and a second middle layer, respectively) disposed between the bottom and top layers 106, 112, respectively. In one embodiment, the thickness and composition of the bottom layer 106 are selected such that the opaque chrome coating 100 has a desired adhesion strength, the thickness and composition of the first middle layer 108 are selected such that the opaque chrome coating 100 has a desired low reflectance, the thickness and composition of the second middle layer 110 are selected such that the opaque chrome coating 100 has a desired opacity, and the thickness, composition, and compressive stress of the top layer 112 are selected such that the opaque chrome coating 100 has a desired pinhole formation resistance.

In one embodiment, the bottom layer 106 contains chrome (Cr) and has a chrome content greater than about 50 at %, preferably greater than about 70 at %, more preferably greater than about 80 at %, and a thickness less than about 10 nm. In one embodiment, the first middle layer 108 contains chrome oxide ($CrO_x$) and has an oxygen content in a range from 35 to 60 at %, preferably in a range from 40 to 60 at %, more preferably in a range from 40 to 66 at % and a thickness in a range from approximately 30 to 52 nm, preferably 34 to 49 nm. In on embodiment, the second middle layer 110 contains chrome (Cr) and has a chrome content greater than 80 at %, preferably greater than 90 at %, and a thickness of at least 90 nm, preferably 100 nm or greater. In one embodiment, the top layer 112 contains chrome oxide ($CrO_x$) and has an oxygen content in a range from 35 to 60 at %, preferably in a range from 40 to in a range from 40 to 66 at %, a thickness of at least 40 nm, preferably in a range from 40 nm to 120 nm, and a compressive stress of at least −20 MPa, preferably less than −100 MPa, more preferably less than −170 MPa.

In one embodiment, the compressive stress in the top layer 112 containing chrome oxide is achieved by depositing the top layer 112 using ion-assisted electron beam evaporation. With ion-assisted electron beam evaporation, a compressive stress of about −174 MPa has been observed in the top layer 112. The bottom layer 106 and any additional layers, e.g., layers 108, 110, may be deposited by thermal evaporation with or without ion-assist. Examples of thermal evaporation techniques include, but are not limited to, electron beam evaporation and resistance evaporation. Preferably, the bottom layer 106 and any additional layers are deposited by electron beam evaporation with or without ion-assist. This would allow all the layers of the opaque chrome coating 100 to be deposited in one vacuum process. Further, the opaque chrome coating 100 having the $Cr/CrO_x/Cr/CrO_x$ structure is formable into an opaque aperture in one process. For example, the same etchants can be used to etch-back chrome and chrome oxide.

Figure 2:
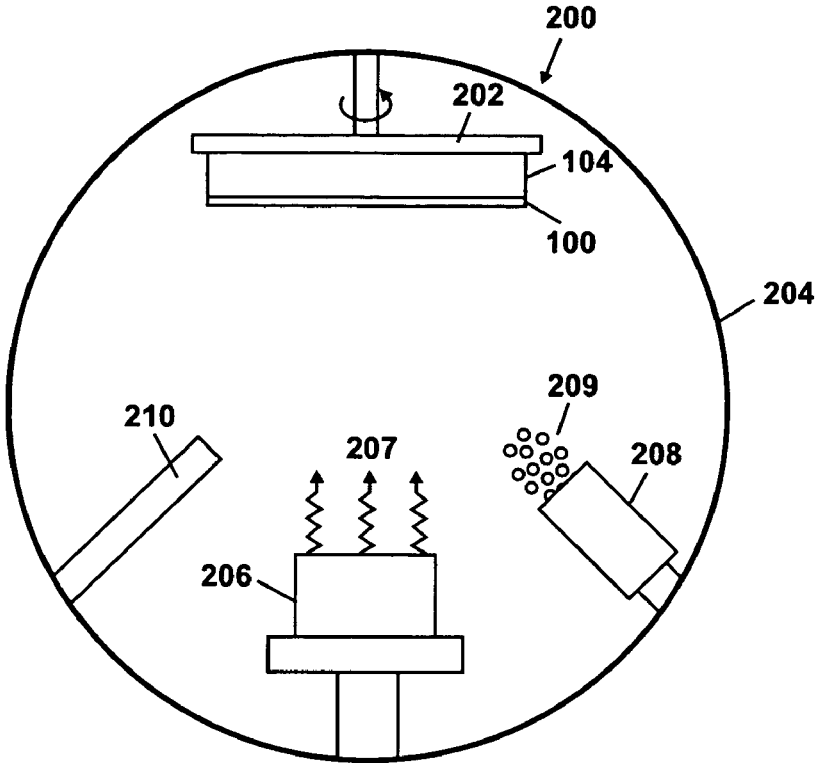
FIG. 2 illustrates a system for depositing an opaque chrome coating on a substrate according to an embodiment of the invention.

FIG. 2 illustrates a system 200 for depositing the opaque chrome coating 100 on the substrate 104. The system 200 includes a rotatable substrate holder 202 for supporting the substrate 104 in a vacuum chamber 204. Below the substrate holder 202 is an electron beam evaporator 206 that uses electron beam to generate vapors 207 from a coating material in a water-cooled crucible (not shown). The electron beam evaporator 206 could include one or more crucibles. The crucible(s) contain a material for forming the layers of the opaque chrome coating 100. The vapors are formed from one crucible at a time. A feedthrough 210 permits reactive gases to enter the chamber 212 above the electron beam evaporator 206. An oxidizing gas such as $O_2$ may be added through feedthrough 210 to react with vapors 207 to form metal oxides such as $CrO_x$. The system 200 also includes an ion source 208, which bombards the film growing on the substrate 104 with ions 209. Typically, the ions 209 are extracted from a plasma. The ion bombardment is needed only for ion-assisted deposition.

Figure 3:
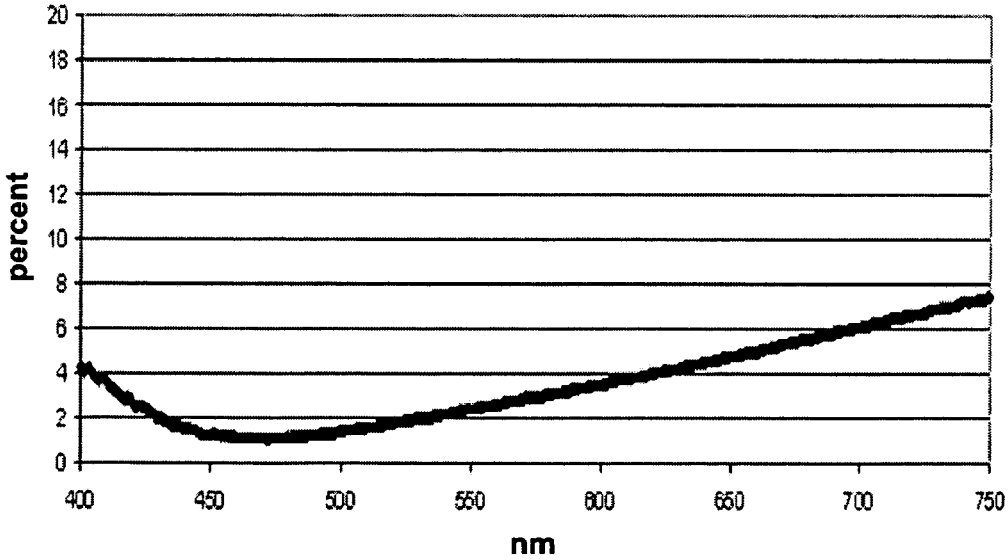
FIG. 3 shows reflectance vs. wavelength for an opaque chrome coating ($Cr/CrO_x/Cr/CrO_x$) stack according to one embodiment of the invention.

Studies show that the thickness of the compressively-stressed top layer (112 in FIG. 1B) plays a role in the degree of elimination of pinholes formed during patterning of the opaque chrome coating. In one example, 40-nm and 100-nm CrOx layers were deposited on opaque $Cr/CrO_x/Cr$ coating layers using ion-assisted electron beam evaporation. The opaque $Cr/CrO_x/Cr/CrO_x$ coatings were patterned with photolithography etch-back. The results show that pinholes larger than 20 μm were eliminated from only the $Cr/CrO_x/Cr/CrO_x$ coating with the 100-nm $CrO_x$ top layer. Studies also show that topping opaque $Cr/CrO_x/Cr$ coating layers with a compressively-stressed $CrO_x$ layer does not affect the reflectance vs. wavelength property of the opaque chrome coating. FIG. 3 shows a typical reflectance vs. wavelength for an opaque $Cr/CrO_x/Cr/CrO_x$ coating at 30° angle of incidence. Studies also show that the opaque chrome coating $Cr/CrO_x/Cr/CrO_x$ stack exhibits excellent adhesion after patterning. The adhesion testing used was a tape test, ISO-9211-4, first edition, section 5, "snap" rate, after the coating was exposed to 15 cycles of thermal shock with −55 to +125° C. temperature extremes per MIL-STD-750D, method 1056.7 test condition C, followed by 10 cycles of moisture resistance per MIL-STD-883E, method 1004.7.

Figure 1C:
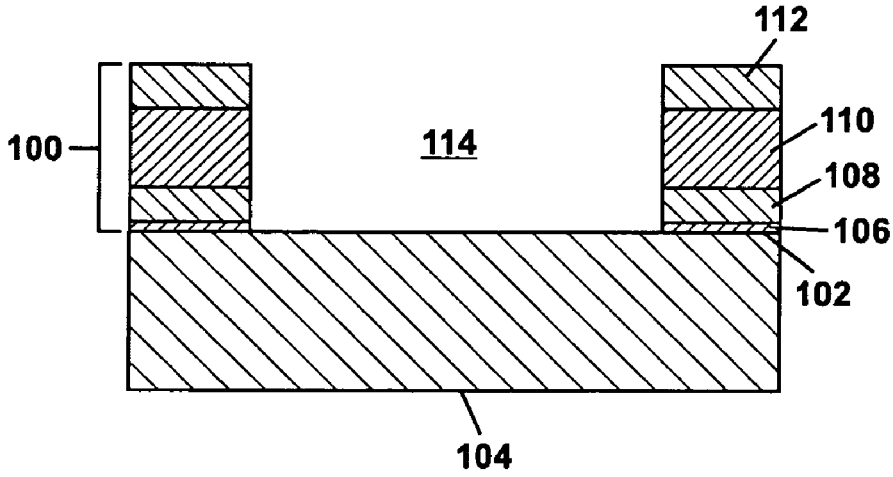
FIG. 1C shows an aperture formed in the opaque chrome coating of FIG. 1B.

FIG. 1C shows an aperture 114 formed in the opaque chrome coating 100. The aperture 114 may be formed by conventional photolithography, which may be wet or dry etch-back or lift-off. In the etch-back process, the opaque chrome coating 100 is deposited on the substrate as described above. A photoresist is then coated on the opaque chrome coating 100 and patterned with the aperture. The opaque chrome coating 100 is then etched back using the photoresist as a mask. Then, the photoresist is removed from the opaque chrome coating 100. The etch rate of chrome oxide in either a chlorine-oxygen plasma (dry etching) or perchloric acid and cerium ammonium nitrate solution (wet etching) is much higher than that of chrome. Thus, the added compressively-stressed chrome oxide top layer adds no additional process steps to pattern the opaque chrome coating, and its addition does not greatly impact the etch times. In the lift-off process, the photoresist is first applied on the substrate and patterned with the aperture. The opaque chrome coating 100 is then deposited on the photoresist, and the photoresist is swollen with a solvent. The photoresist and the coating above it are subsequently removed from the substrate.

The invention typically results in the following advantages. A compressively-stressed top layer can be added to a standard opaque chrome coating to increase the pinhole formation resistance of the opaque chrome coating, thereby making the opaque chrome coating more robust during downstream processing, such as cleaning and photolithography. A compressively-stressed chrome oxide ($CrO_x$) top layer can be deposited economically on a standard opaque chrome coating using ion-assisted electron beam evaporation. Ion-assisted deposition has an added advantage of producing films that are dense and uniform, leading to an opaque chrome coating having more consistent optical properties. The compressively-stressed $CrO_x$ top layer can be deposited in the same process as the remaining layers of the opaque chrome coating. An opaque $Cr/CrO_x/Cr/CrO_x$ coating can be etched-back in one process.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A substrate with a patterned opaque coating formable into an opaque aperture in one process, the opaque coating comprising at least a bottom layer and a top layer, the bottom and top layers each comprising a material selected from the group consisting of chrome and chrome oxide, the top layer having a compressive stress;

wherein the thickness of the top layer ranges from approximately 40 nm to 120 nm, and the compressive stress in the top layer is at least −100 MPa.

2. The substrate of claim 1, wherein the top layer comprises chrome oxide.

3. The substrate of claim 2, wherein top chrome oxide layer has an oxygen content in the range of approximately 35 to 60 at %.

4. The substrate of claim 2, wherein the bottom layer comprises chrome.

5. The substrate of claim 4, wherein the chrome content of the bottom layer is greater than approximately 50 at %.

6. The substrate of claim 4, wherein the bottom layer has a thickness less than approximately 10 nm.

7. The substrate of claim 1, wherein the compressive stress in the top layer is less than −170 MPa.

8. The substrate of claim 1, further comprising at least one middle layer between the bottom and top layers.

9. The substrate of claim 8, wherein the at least one middle layer comprises chrome.

10. The substrate of claim 9, wherein the chrome content of the at least one middle layer is greater than approximately 80 at %.

11. The substrate of claim 9, wherein a thickness of the at least one middle layer of chrome is approximately 90 nm or greater.

12. The substrate of claim 8, wherein the at least one middle layer comprises chrome oxide.

13. The substrate of claim 12, wherein an oxygen content of the at least one middle layer of chrome oxide ranges from approximately 35 to 60 at %.

14. The substrate of claim 12, wherein the at least one middle layer of chrome oxide has a thickness in a range from approximately 30 to 52 nm.

15. The substrate of claim 1, wherein an aperture is formed in the opaque coating.

16. A substrate wit a patterned opaque coating formable into an opaque aperture in one process, the opaque coating comprising a bottom layer containing chrome, followed by a first middle layer containing chrome oxide, followed by a second middle layer containing chrome, followed by a top layer containing chrome oxide, wherein the top layer has a compressive stress of at least −100 MPa.

17. The substrate according to claim 16, wherein the compressive stress of the top layer is less than −170 Mpa.

18. The substrate according to claim 16, wherein the thickness of the bottom layer is at least 10 nm, the thickness of the first middle layer is in the range 30 nm to 52 nm, the thickness of the second middle layer is at least 90 nm, and thickness of the top layer is in the range 40 nm to 120 nm.

19. A method of making a substrate with a patterned opaque coating formable into an opaque aperture in one process, comprising:

depositing a bottom layer on a surface of the substrate; and depositing a top layer on the bottom layer such that the top layer has a compressive stress;

wherein the bottom and top layers each comprise a material selected from the group consisting of chrome and chrome oxide;

the top layer has a compressive stress of at least −100 MPa; and the top layer has a thickness in the range of 40 nm to 120 nm.

20. The method of claim 19, wherein the top layer is deposited by electron beam evaporation with ion assist.

21. The method of claim 19, wherein the bottom layer is deposited by thermal evaporation.

22. The method of claim 19, further comprising depositing one or more additional layers between the bottom layer and the top layer prior to depositing the top layer.

23. The method of claim 19, further comprising coating the surface of the substrate with a patterned photoresist prior to depositing the bottom and top layers.

24. The method of claim 19, further comprising patterning an aperture in the bottom and top layers by photolithography.

25. The method of claim 19, further comprising depositing one additional layer between the bottom layer and the top layer, wherein when said addition layer is deposited, the additional layer is chrome oxide and the top layer is chrome having a compressive stress of less than −170 MPa.

26. The method of claim 19, further comprising depositing a first middle layer and a second middle layer between the bottom layer and the top layer, wherein when said first and second middle layer are deposited, the first middle layer is chrome oxide, the second middle layer is chrome and the top layer is chrome having a compressive stress of less than −170 MPa.

* * * * *